US005103067A

United States Patent [19]

Aldissi

[11] Patent Number: 5,103,067

[45] Date of Patent: Apr. 7, 1992

[54] SHIELDED WIRE AND CABLE

[75] Inventor: Mahmoud Aldissi, Colchester, Vt.

[73] Assignee: Champlain Cable Corporation, Winooski, Vt.

[21] Appl. No.: 691,571

[22] Filed: Apr. 25, 1991

Related U.S. Application Data

[63] Continuation-in-part of Ser. No. 656,658, Feb. 19, 1991, abandoned.

[51] Int. Cl.[5] ..... H01B 7/34

[52] U.S. Cl. ..... 174/36; 174/34; 174/107; 174/109

[58] Field of Search ..... 174/36, 107, 109, 32, 174/34

[56] References Cited

U.S. PATENT DOCUMENTS

| | | | |
|---|---|---|---|
| 4,301,428 | 11/1981 | Mayer | 174/36 X |
| 4,408,089 | 10/1983 | Nixon | 174/34 |
| 4,506,235 | 3/1985 | Mayer | 174/36 X |
| 4,684,762 | 8/1987 | Gladfelter | 174/36 |
| 4,822,950 | 4/1989 | Schmitt | 174/36 |
| 4,920,233 | 4/1990 | Kincaid | 174/36 |
| 4,960,965 | 10/1990 | Redmon et al. | 174/36 X |

FOREIGN PATENT DOCUMENTS

| | | | |
|---|---|---|---|
| 244008 | 3/1987 | Fed. Rep. of Germany | 174/36 |
| 1019727 | 11/1957 | Fed. Rep. of Germany | 174/36 |
| 2622297 | 12/1977 | Fed. Rep. of Germany | 174/36 |
| 40886 | 4/1978 | Japan | 174/109 |
| 999545 | 7/1965 | United Kingdom | 174/36 |

*Primary Examiner*—Morris H. Nimmo
*Attorney, Agent, or Firm*—Salzman & Levy

[57] ABSTRACT

The present invention features a shielded wire and cable article capable of meeting stringent aerospace specifications and requirements, particularly that of low weight. The article generally comprises an inner conductive core of one or more wires that can be bare or individually insulated, and that can be straight, twisted or braided within the core. The core can also comprise a multicore consisting of a plurality of core members. The conductive core is surrounded by one or more thin layer(s) of insulation about which the shielding of this invention is applied. The shielding comprises a braided or served mesh or woven yarn of metallically coated fibers, characterized by high tensile strength and flexibility. Where the fibers themselves are braided, the resulting mesh can be braided more tightly about the interior insulation surface than can conventional meshes. Also, the high tensile strength requirement for the yarn permits a thinner fiber to be utilized, wherein a greater shield weight reduction can be realized. This thinner metal coating greatly reduces the shielding weight of the shield mesh.

15 Claims, 4 Drawing Sheets

SHIELDED WIRE AND CABLE

RELATED PATENT APPLICATION

This application is a continuation-in-part of the previously filed application, Ser. No. 07/656,658, Feb. 19, 1991 entitled "Shielded Wire And Cable," now abandoned. Priority is hereby claimed to all subject matter common between the two applications.

FIELD OF THE INVENTION

The invention relates to shielded wire and cable, and more particularly to improved shielded wire and cable providing several orders of magnitude of shielding improvement over standard shielded wire and cable, and additionally, shielded wire and cable that is lighter in weight than conventional shielded wire and cable articles.

BACKGROUND OF THE INVENTION

Advanced technological uses for wire and cable have imposed many new requirements upon traditional wire and cable specifications and functions. In missile and aerospace environments, for example, the need for lighter weight cabling is directly related to aircraft performance and operating cost. Also, wiring is often required to meet stringent shielding specifications, since it is contemplated that the missile or aircraft will have to fly through radiation and electrical interference fields without compromising the on-board electronics.

Presently, wire and cables are shielded electrically by braiding wire mesh shields about the primary wire core and insulation. This shielding is meant to prevent RFI and EMI disturbances from influencing the signals in the cable.

As the advanced technology requirements impose greater stringency in shielding and weight specifications, these previously functional braided articles become unacceptable. Shielding leakages occur in these conventional cables by virtue of the looseness by which the wire mesh is braided, leaving holes in the shield web. In addition, the stiffness of the metal wire used in braiding makes it difficult to conform the mesh to the insulation core surfaces, leaving small gaps. Such gaps limit the frequency range in which the cable or wire can be operationally effective. While it may be possible to use finer wire mesh to resolve some of the above-mentioned shielding problems, it is still necessary to contend with the lower weight requirements that these environments impose. The lower weight requirements cannot be practically met by using wire mesh braiding techniques.

The present invention has resolved the aforementioned problems by the development of a new type of shielded wire and cable article. The new article of this invention contemplates the use of shielding composed of fine mesh yarns or fibers that have been metallically coated with an extremely thin layer of material. The metallic layer is coated upon the fibers in thin layers. The yarns contemplated for use in the invention have high tensile strength and flexibility, in which nylon, Kevlar, or carbon fibers have proven acceptable.

The high tensile strength and flexibility of the fibers of this invention ensures that the fibers can be made thin without losing structural integrity. The thinner the fiber, the tighter it can be braided or woven; and hence, the greater the shielding effectiveness. Also, the greater flexibility of the fiber mesh, as compared to wire mesh, provides a greater conformity to the surface of the underlying insulation. Such improved conformity further improves the closeness and tightness of the mesh shield. This also contributes to a higher shielding frequency range capability.

The fibers have a clear weight advantage over that of metallic wire, providing the solution to the most vexing aspect of the new aerospace specifications.

DISCUSSION OF RELATED ART

It is known in the art to coat fibers with metal, and to braid these fibers into a wire article. Such a teaching is shown in U.S. Pat. No. 4,634,805, issued to Ralph Orban on Jan. 6, 1987, entitled "Conductive Cable or Fabric." The patent also suggests that a mesh can be manufactured utilizing the metal coated fibers. But the use of metallic coated fibers is not taught therein for the purposes of fabricating shielded wire and cable. Nor does the patent teach the use of yarn, nor the yarn sizes and metal thicknesses necessary to accomplish the shielding frequency ranges contemplated by this invention. Furthermore, the silver-coated yarn differs from what is known in the art by the fact that the silver coat of the invention is chemically anchored to the fibers rather than merely physically deposited. This difference is significant, since it provides the fiber of this invention with electrical continuity and prevents the coating from cracking.

SUMMARY OF THE INVENTION

In accordance with the present invention, there is provided a shielded wire and cable article capable of meeting stringent aerospace specifications and requirements, particularly that of low weight. The article generally comprises an inner conductive core of one or more wires that can be twisted or braided, and which can be individually insulated. The conductive core is surrounded by one or more thin layer(s) of insulation about which the shielding of this invention is applied. The shielding comprises a braided or served mesh or woven yarn of metallically coated fibers. The fibers of the yarn or mesh are characterized by high tensile strength and flexibility. Where the fibers themselves are braided, the resulting mesh can be braided more tightly about the interior insulation surface than can conventional meshes.

Also, the high tensile strength requirement for the yarn provides that a thinner fiber can be utilized, wherein a greater shield weight reduction can be realized. The metal coating upon the shield fibers is approximately in a thickness range of a few tens to a few hundred angstroms. The thinner metal coating greatly reduces the shielding weight of the shield mesh.

The yarn can be fabricated from nylon, Kevlar (an aromatic polyamide or aramid, or carbon fibers, having a weight in an approximate range of about 50 to a few hundred denier, and in some cases up to 10,000 denier. Other flexible, high tensile fibers are also contemplated by the invention. About the fiber shield, a thin insulative jacket is disposed to complete the shielded wire or cable article of this invention.

The shielding effectiveness (operational frequency range) of the resulting inventive article is comparable to that of conventional shielded cable. The surface transfer impedance of the shielded wire and cable of the invention is approximately in a range approaching a few hundred milliohms/meters over a frequency range of 100 KHz to 1 GHz. A typical total cable weight for a silver coated nylon braided shield utilized in the wire and cable article of the invention is approximately 0.4 lbs per 1,000 feet, as compared to a tin-copper braided wire mesh cable having a total weight of 0.76 lbs per 1,000 feet.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Figure 1:
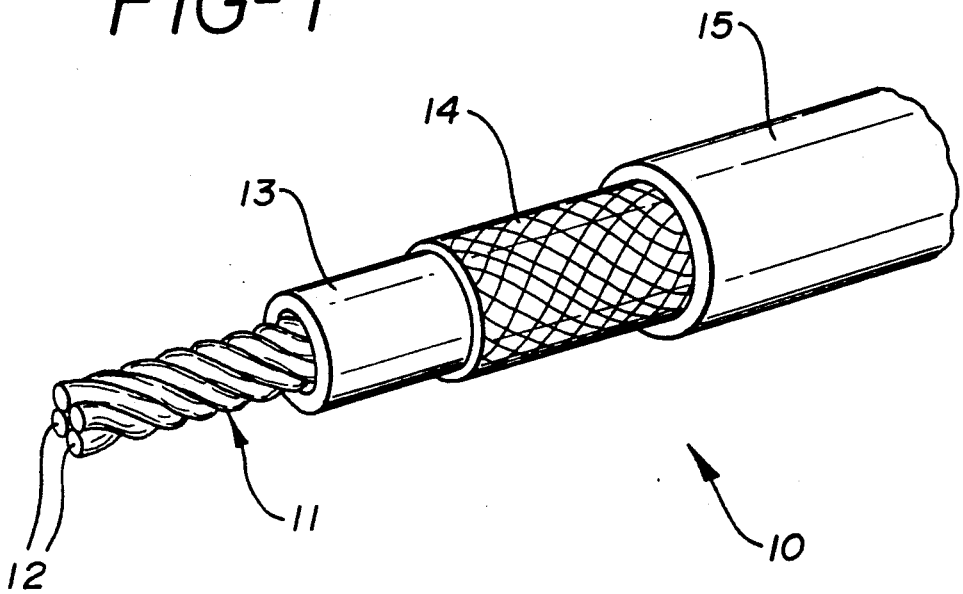
FIG. 1 is a schematic, cutaway, perspective view of the shielded wire or cable article of this invention.

Generally speaking, the present invention features a shielded wire and cable article whose shielding is fabricated from metallic coated fibers woven into a yarn or braided into a mesh. The shielding layer of the invention utilizes highly flexible fibers with a high tensile strength. The yarn or braided mesh is disposed about the inner insulated core of the wire or cable. The metallic coating upon the fibers is very thin, and comprises a layer of approximately between a few tens to a few hundreds angstroms in thickness. The weight of the braided fibers is as low as 22% of the conventional metallic mesh, and provides shielding effectiveness comparable to that of conventional metallic mesh. Now referring to FIG. 1, a typical shielded wire or cable article 10 of this invention is illustrated in schematic, cutaway perspective view. The inner, electrically conductive core 11 of the wire or cable 10 is composed of one or more metallic wires 12, usually of copper. The wires 12 can be straight, twisted or braided, as is conventionally known in the art, and may be bare or individually insulated. The conductive core 11 is covered by one or more thin insulation layer(s) 13, which insulation can be any suitable material as befits the utility and specifications sought to be met. One of the insulation layers 13 may contain ferrite powder.

About the insulation layer(s) 13, the shielding layer 14 of this invention is overlaid. The shielding layer 14 can be applied in one of two ways: a) as a thin layer of woven yarn, or b) as a braided or served layer of fibers. The fibers of the yarn or braid are coated with a metal, usually silver. The thickness of metal coating about each fiber is generally in a range of approximately between a few tens to a few hundreds angstroms in thickness. The fibers are characterized by their high tensile strength and flexibility, thus allowing a tightly woven yarn or braided mesh.

Because of their high tensile strength and flexibility, the fibers can be made thinner, thus reducing their weight and providing for a tighter weave or braiding about the insulation layer 13. The fibers can be chosen from many high tensile strength materials, such as nylon, Kevlar (an aromatic polyamide or aramid), carbon fibers, etc. The fibers generally have a weight range of approximately between 50 to a few hundred denier, and in some cases up to 10,000 denier.

Figure 1A:
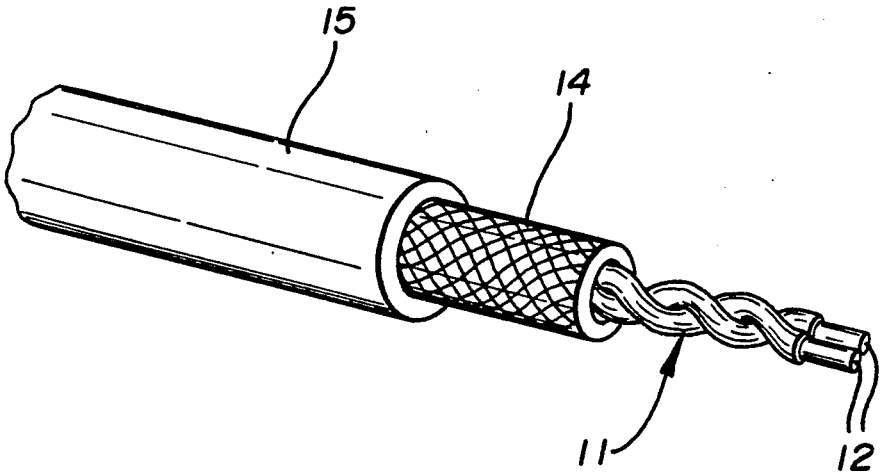
FIG. 1*a* is a schematic, cutaway, perspective view of an alternate embodiment of the shielded cable article illustrated in FIG. 1, wherein the cable forms a twin pair.

Referring to FIG. 1*a*, an alternate embodiment of the cable 10 shown in FIG. 1, illustrates a twin cable construction for the shielded article of this invention.

The metallic coating is applied by a proprietary process, commercially available from Sauquoit Industries, Inc., of Scranton, Pennsylvania. Other commercially available processes that can be utilized in coating the metal on the fibers are known, such as electrostatic deposition, dielectric deposition, vapor deposition, etc. Over the shield layer 14 is generally disposed one or more jacket layers 15 of insulation. The jacket layer(s) 15 can be any number of materials, again befitting the intended purposes and specifications designated for the final cable product.

EXAMPLE 1

A wire construction was fabricated utilizing the following materials:

For the conductive core, a center conductor was utilized, comprising AWG 22 tin-coated copper wire manufactured by Hudson Wire Company. The conductive core was overlaid with a layer of primary insulation of Kynar 460 polyvinylidene fluoride supplied by Atochem Company. About this primary insulation was overlaid a second insulation layer of Viton fluorinated rubber filled with ferrite powder (82%) supplied by DuPont. The second layer was then overlaid with Exrad ®, an irradiated, cross-linked ethylene tetrafluoroethylene copolymer manufactured by Champlain Cable Corporation, Winooski, Vermont. The third layer was overlaid with the shielding of this invention. The final wire was not jacketed. The total outside diameter was 0.069". The shielding consisted of silver-coated Kevlar fibers whose weight was approximately 0.4 lbs per 1,000 feet, braided into a mesh about the insulation layers.

Conventional tin-copper braided wire has twice the weight of the metallic coated fiber shielding of the invention. This results in a total cable weight of approximately 0.76 lbs per 1,000 feet.

Figure 2:
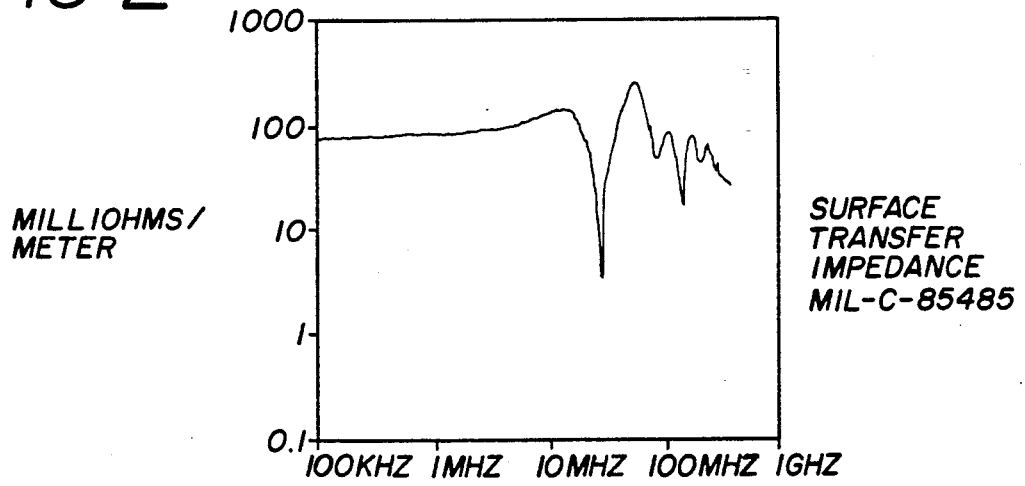
FIGS. 2 through 8 represent graphical representations of shielding data obtained for various shielded wire and cable articles fabricated in accordance with the invention, and compared with standard wire braided shield articles.
Figure 3:
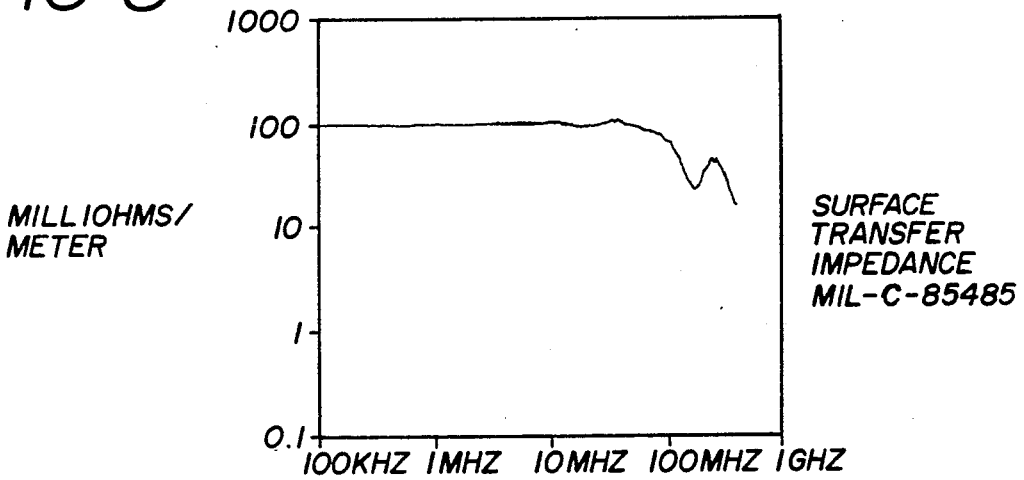

The shielding effectiveness of the fabricated article in EXAMPLE 1 was measured via surface transfer impedance measurement, and was compared to cable fabricated with the conventional shield of tin-copper braid. The results are shown in FIGS. 2 and 3, respectively. The tin-coated copper braid provided 92% coverage, whereas that of the silver-coated Kevlar produced a 99% coverage of the underlying insulation. The resulting shielding of the invention shows a effectiveness comparable to that of the conventional shielding.

Figure 4:
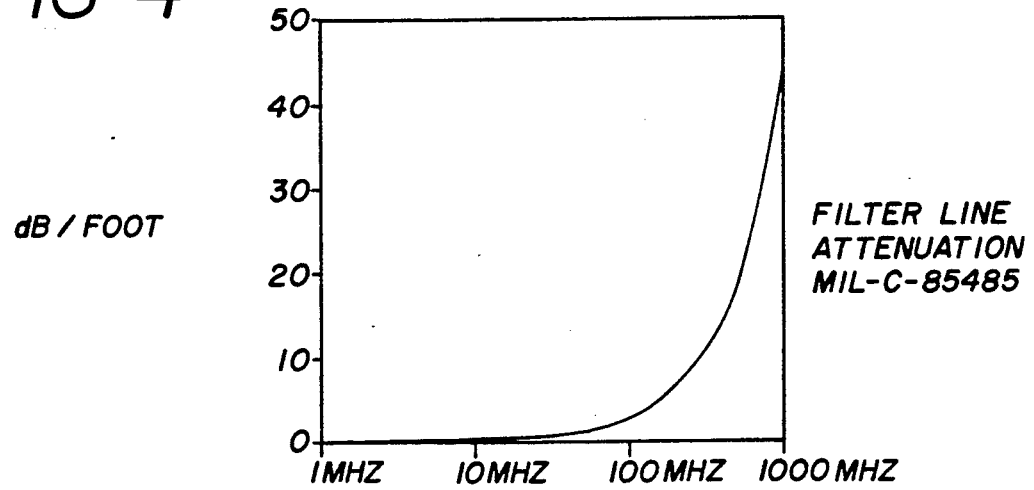

Attenuation measurements were the same as those obtained with a metal braided shield (FIG. 4).

EXAMPLE 2

A second cable was fabricated utilizing the silver-plated copper core (AWG 22) of EXAMPLE 1. About the conductive core was overlaid an insulation layer of irradiation cross-linked ethylene tetrafluoroethylene copolymer. The insulated conductive core consisted of a twisted pair whose length of lay is about one inch (lefthanded lay). A shield was disposed over the twisted pair, and consisted of the same silver-coated Kevlar braid, having a 96% coverage. Over this was jacketed a layer of cast tape (FEP-coated teflon).

A counterpart to this cable was fabricated with metal braided silver-plated copper flat mesh consisting of a twisted pair (two conductors) whose length of lay was about 1" (left hand lay) having an 86% coverage.

Figure 5:
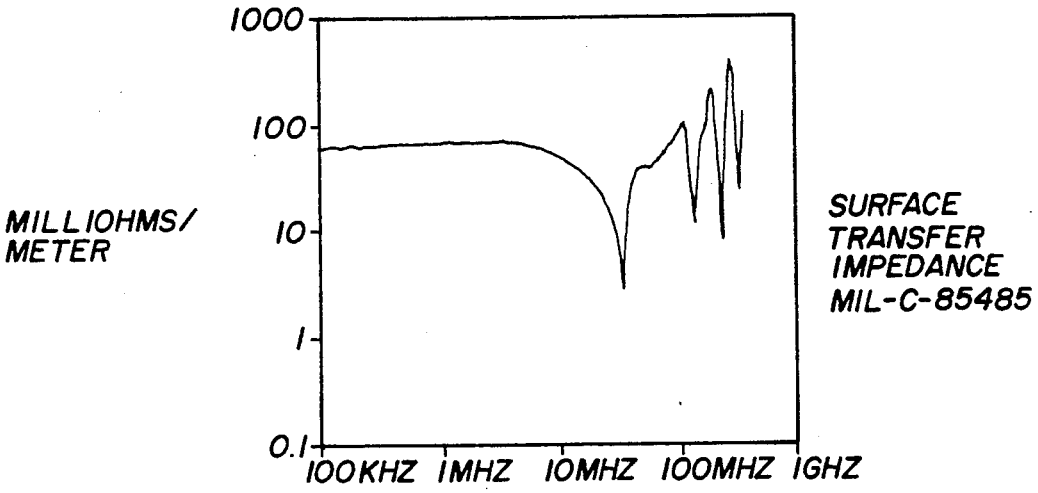
Figure 6:
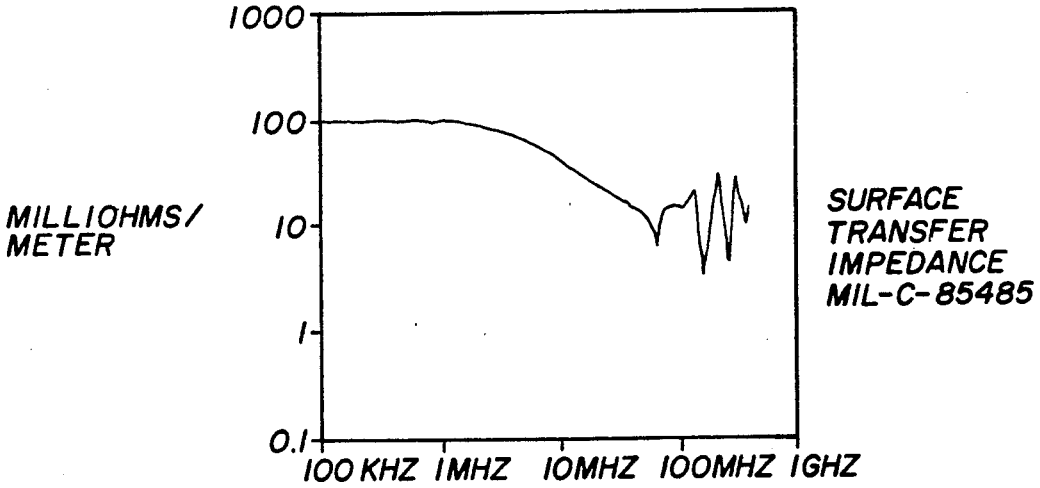

The results of the shielding effectiveness of the inventive article compared to the conventional cable is illustrated in FIGS. 5 and 6, respectively.

Comparison of the total weight of the shielded cable is as follows:

Kevlar-braided fiber cable weighed 0.735 lb/1,000'
silver-plated copper cable weighed 0.86 lb/1,000'.

The insulation thickness on each of the wires of the r twisted pair was 0.0065" and the FEP tape thickness (jacket) was 0.0014".

EXAMPLE 3

A cable was fabricated with the construction similar to that described in EXAMPLE 1, with the exception that the braid consisted of a mixed mesh of metal-coated fibers and metal-coated wire. A 16-carrier braiding machine with 8 spools of silver coated nylon and 8 spools of silver-plated copper was used to fabricate the mixed mesh.

Figure 7:
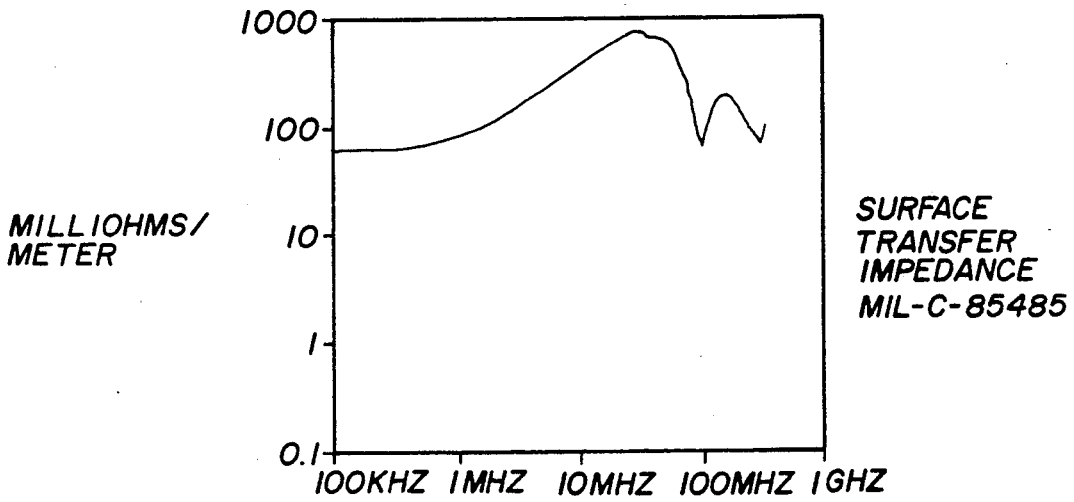

The shielding effectiveness is shown in FIG. 7. A similar result is obtained when braiding the two mesh components (i.e., the fiber and wire) in two separate braiding operations.

EXAMPLE 4

Figure 8:
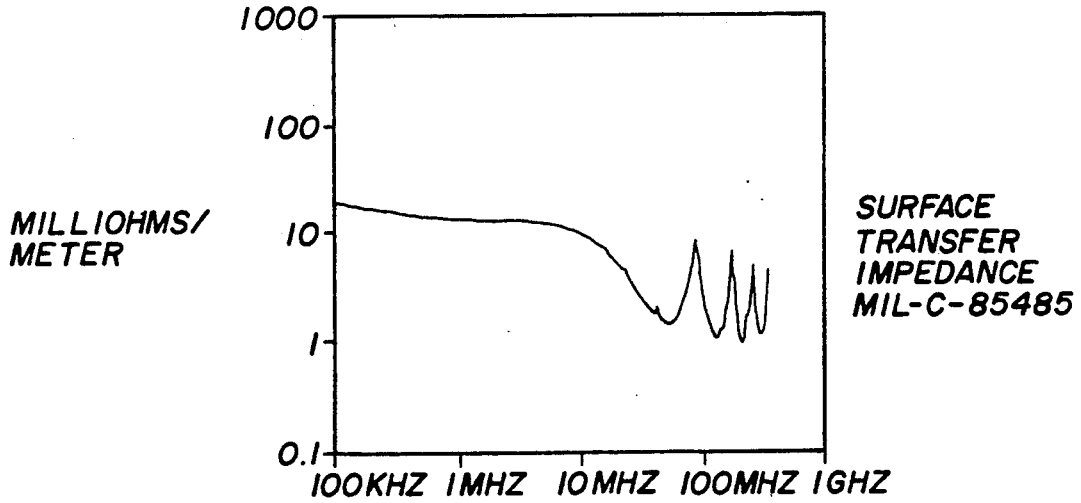

An RG 302 coaxial cable was modified in accordance with the invention. The cable normally comprises a silver-plated copper solid conductor (AWG 22, OD=0.025") insulated with polyethylene (total OD=0.143") and shielded with a silver-plated copper braid (92% coverage). The coaxial cable was modified by replacing the metal shield layer with a silver-plated nylon braid. Transfer impedance results were similar to those of the original RG 302 metal-braided coaxial cable, as illustrated in FIG. 8.

A fabric Wardwell braiding machine, manufactured by Wardwell Braiding Machine Company of Rhode Island, was used with 16 or 24 spools of a 2-end silver coated nylon yarn.

The conductive core of the cable of this invention can comprise one or more bare metallic wires or metallic wires having individual layers of insulation. These wires may be straight, twisted or braided, and then covered with a layers of insulation and jacketing.

The cable article of this invention may be fabricated as a cable pair. Insulated cores can themselves be paired or be formed into a multicore member, which can then be shielded and jacketed.

The jacket layer(s) can comprise at least one material selected from a group of materials consisting of: fluoropolymer, fluorocopolymer, polyimide, halogen-free insulation, and irradiated, cross-linked ethylenetetrafluoroethylene polymer.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented by the subsequently appended claims.

What is claimed is:

1. A cable article having shielding against EMI and RFI, comprising:

a conductive core member;

at least one layer of insulation disposed over said conductive core member;

a layer of shield material consisting of metallic coated aramid fibers that are braided into a mesh to provide a protective shield layer disposed over the insulated conductive core member, said braided mesh forming a shield layer that exceeds 96% coverage of said at least one layer of insulation and providing shielding effectiveness of at least approximately between $10^1$ and $10^3$ ohms of impedance across a frequency range of between 100 KHz and 300 MHz; and a jacket disposed over said protective shield layer comprising at least one layer of material.

2. The cable article in accordance with claim 1, wherein said protective shield layer comprises fibers coated with silver.

3. The cable article in accordance with claim 1, wherein said conductive core member comprises a plurality of metallic wires that are straight, braided or twisted.

4. The cable article in accordance with claim 1, wherein said conductive core member comprises a plurality of metallic wires that are individually insulated.

5. The cable article in accordance with claim 1, formed into a twin pair of cables.

6. The cable article in accordance with claim 1, wherein said conductive core member comprises a multicore member.

7. The cable article in accordance with claim 1, wherein said jacket is selected from at least one material from a group of materials consisting of: fluoropolymer; fluorocopolymer; polyimide; halogen-free insulation; and irradiated, cross-linked ethylenetetrafluoroethylene polymer.

8. The cable article in accordance with claim 1, wherein said at least one insulation layer is selected from at least one material from a group of materials consisting of: fluoropolymer; fluorocopolymer; polyimide; halogen-free insulation; and irradiated, cross-linked ethylene-tetrafluoroethylene polymer.

9. The cable article of claim 1, wherein the aramid fibers are coated with a metal layer comprising approximately between 15% to 40% by weight of the fiber.

10. The cable article of claim 1, wherein said shield layer further comprises metal wires braided with said aramid fibers to provide a combination mesh of wire and fiber.

11. A light weight cable article having shielding against EMI and RFI, comprising:

a conductive core member;

at least one layer of insulation disposed over said conductive core member;

a layer of shield material consisting of metallic coated aramid fibers having a diameter of approximately between 50 and 10,000 densier, that are braided into a mesh to provide a protective shield layer disposed over the insulated conductive core member and covering said insulated conductive core member in excess of approximately 96% to provide shielding effectiveness of at least approximately between $10^1$ and $10^3$ ohms of impedance across a frequency range of between 100 KHz and 300 MHz; and a jacket layer disposed over said protective shield layer.

12. The cable article in accordance with claim 11, wherein said protective shield layer comprises fibers coated with silver.

13. The cable article in accordance with claim 11, wherein said conductive core member comprises a plurality of metallic wires that are braided or twisted.

14. The cable article of claim 11, wherein the aramid fibers are coated with a metal layer comprising approximately between 15% to 40% by weight of the fiber.

15. The cable article of claim 11, wherein said shield layer further comprises metal wires braided with said aramid fibers to provide a combination mesh of wire and fiber.

* * * * *

UNITED STATES PATENT AND TRADEMARK OFFICE

CERTIFICATE OF CORRECTION

PATENT NO. : 5,103,067

DATED : April 7, 1992

INVENTOR(S) : Mahmoud Aldissi

It is certified that error appears in the above-indentified patent and that said Letters Patent is hereby corrected as shown below:

Column 4, line 47, delete "FIGS. 2 and 3" and substitute therefor —FIGS. 3 AND 2—.
Column 5, line 5, delete "FIGS. 5 AND 6" and substitute therefor —FIGS. 6 AND 5—.
Column 5, line 10, delete "r".
Column 5, line 46, delete "a".
Column 6, line 11, delete "ohms" and insert therefor —milliohms per meter—.
Column 6, line 57, delete "diameter" and substitute therefor —fiber weight/length ratio—.
Column 6, line 58, delete "densier" and substitute therefor —denier—.
Column 6, line 64, delete "ohms" and substitute therefor —milliohms/meter—.

Signed and Sealed this

Sixteenth Day of January, 1996

*Attest:*

*Attesting Officer*

BRUCE LEHMAN

*Commissioner of Patents and Trademarks*